US005975033A

United States Patent [19]

Wada

[11] Patent Number: 5,975,033

[45] Date of Patent: Nov. 2, 1999

[54] WATER-COOLED ENGINE

[75] Inventor: Tetsu Wada, Wako, Japan

[73] Assignee: Honda Giken Kogyo Kabushiki Kaisha, Tokyo, Japan

[21] Appl. No.: 09/017,812

[22] Filed: Feb. 3, 1998

[30] Foreign Application Priority Data

Feb. 3, 1997 [JP] Japan ..... 9-020456

[51] Int. Cl.[6] ..... F02F 1/36

[52] U.S. Cl. ..... 123/41.82 R; 440/89; 440/900

[58] Field of Search ..... 123/41.82 R, 195 P; 440/89, 900

[56] References Cited

FOREIGN PATENT DOCUMENTS 63-253157 10/1988 Japan .

3-168353 7/1991 Japan .

*Primary Examiner*—Noah P. Kamen

*Attorney, Agent, or Firm*—Nikaido, Marmelstein, Murray & Oram LLP

[57] ABSTRACT

Each of combustion chambers 37 in a cylinder head 8 and an opening 45 in a cylinder block/cylinder head coupling surface 36 are connected to each other by a pair of exhaust passages 42. A cooling water passage 94 is defined within a partition wall 44 partitioning both the exhaust passages 42, and constitutes a portion of a cooling water jacket for cooling portions near the exhaust passages 42. The cooling water passage 94 extends within the partition wall 44 to near each of the combustion chamber 37 and moreover, communicates with a cooling water jacket in a cylinder block through openings 83 and 87. Thus, the cooling performance for the water-cooled engine including the pair of exhaust passage for each of the combustion chambers can be enhanced.

5 Claims, 11 Drawing Sheets

WATER-COOLED ENGINE

BACKGROUND OF THE INVENTION

1. Field of the Invention

The present invention relates to a water-cooled engine including at least two exhaust valves in correspondence to each combustion chamber.

2. Description of the Related Art

Disclosed in Japanese Patent Application Laid-open No.3-168353 is an engine in which an exhaust passage extending from a single exhaust valve mounted for each of combustion chambers in a cylinder head opens at its downstream end into a cylinder head/cylinder block coupling surface. Disclosed in Japanese Patent Application Laid-open No.63-253157 is an engine in which a pair of exhaust passages extending from two exhaust valves mounted for each of combustion chambers open at their downstream ends into an outer surface of a cylinder head different from a cylinder block/cylinder head coupling surface.

When the downstream ends of the pair of exhaust passages from the two exhaust valves mounted for each of combustion chambers open into the cylinder block/cylinder head coupling surface, a partition wall partitioning both the exhaust passages is heated to an extremely high temperature by a heat of an exhaust gas and hence, it is necessary to take account of the shape of a cooling water jacket so as to be able to effectively cool the partition wall.

SUMMARY OF THE INVENTION

Accordingly, it is an object of the present invention to enhance the cooling performance of a water-cooled engine including a pair of exhaust passages for each of combustion chambers.

To achieve the above object, according to a first aspect and feature of the present invention, there is provided a water-cooled engine comprising a cylinder block including a cylinder, a cylinder head coupled to the cylinder block and including combustion chambers connected to the cylinder, a pair of exhaust bores which open into each of the combustion chambers, a pair of first exhaust passages defined in the cylinder head and extending from the pair of exhaust bores to a cylinder head/cylinder block coupling surface, a partition wall which is formed in the cylinder head and partitions the pair of first exhaust passages, a second exhaust passage defined in the cylinder block and communicates with the first exhaust passages in the coupling surface, and a cooling water jacket defined in the cylinder head to cool the pair of first exhaust passages, wherein the cooling water jacket includes an intra-wall passage defined in the partition wall, the intra-wall passage communicating with the cooling water jacket defined in the cylinder block through the coupling surface.

With the above arrangement, the pair of first exhaust passages in the cylinder head, which are connected to each of the combustion chambers, are defined to sandwich the partition wall therebetween, and a portion of the cooling water jacket defined in the cylinder head to cool portions near the first exhaust passages extends within the partition wall to form the intra-wall passage. Therefore, the effect of cooling the cylinder head is enhanced by cooling the partition wall by the cooling water flowing through the intra-wall passage. In addition, since the intra-wall passage communicates with a cooling water jacket in the cylinder block through the cylinder head/cylinder block coupling surface, the flowing of the cooling water between the cooling water jacket in the cylinder head and the cooling water jacket in the cylinder block is promoted to enhance the cooling effect.

According to a second aspect and feature of the present invention, in addition to the first feature, a cooling water jacket defined in the cylinder block and communicating with the intra-wall passage is located outside the second exhaust passage as viewed from the cylinder.

With the above arrangement, the intra-wall passage in the cylinder head and the cooling water jacket in the cylinder block communicate with each other outside the second exhaust passage and therefore, a portion near the second exhaust passage adjacent the cooling water jacket can be effectively cooled.

According to a third aspect and feature of the present invention, in addition to the first feature, a cooling water jacket defined in the cylinder block and communicating with the intra-wall passage is located inside the second exhaust passage as viewed from the cylinder.

With the above arrangement, the intra-wall passage in the cylinder head and the cooling water jacket in the cylinder block communicate with each other inside the second exhaust passage in the cylinder block and therefore, the combustion chambers in the cylinder head and a high-temperature portion near the first exhaust passage can be effectively cooled.

According to a fourth aspect and feature of the present invention, there is provided a water-cooled engine, comprising a cylinder block including cylinder, a cylinder head coupled to the cylinder block and including combustion chambers connected to the cylinder, a pair of exhaust bores which open into each of the combustion chambers, a pair of first exhaust passages defined in the cylinder head and extending from the pair of exhaust bores to a cylinder head/cylinder block coupling surface, a partition wall which is formed in the cylinder head and partitions the pair of first exhaust passages, a second exhaust passage defined in the cylinder block and communicating with the first exhaust passages in the coupling surface, and a cooling water jacket defined in the cylinder head to cool the pair of first exhaust passages, wherein the cooling water jacket includes a cooling water jacket portion including an intra-wall passage defined in the partition wall, and a cooling water jacket portion which extends around the combustion chambers and permits the intra-wall passage to communicate with a cooling water jacket defined in the cylinder block.

With the above arrangement, the pair of first exhaust passages in the cylinder head, which are connected to each of the combustion chambers, are defined to sandwich the partition wall therebetween, and a portion of the cooling water jacket defined in the cylinder head to cool portions near the first exhaust passages extends within the partition wall to form the intra-wall passage. Therefore, the effect of cooling the cylinder head is enhanced by cooling the partition wall by the cooling water flowing through the intra-wall passage. In addition, since the cooling water jacket portion is defined in the cylinder head to extend around the combustion chamber to permit the intra-wall passage to communicate with the cooling water jacket in the cylinder block, high-temperature portions near the combustion chambers can be effectively cooled by the cooling water jacket. Further, since the cooling water jacket portion permitting the intra-wall passage to communicate with the cooling water jacket in the cylinder block opens into the cylinder head/cylinder block coupling surface, this cooling water jacket can be formed in a mother die for forming the cylinder head in a casting process, which can contribute to a reduction in producing cost.

The above and other objects, features and advantages of the present invention will become apparent from the following description of the preferred embodiment taken in conjunction with the accompanying drawings.

BRIEF DESCRIPTION OF THE DRAWINGS

FIGS. 1 to 12 illustrate an embodiment of the present invention, wherein FIG. 1 is a right side view of the entire outboard engine system;

FIG. 2 is a left side view of an engine;

FIG. 3 is an enlarged sectional view taken along a line 3—3 in FIG. 2;

FIG. 4 is an enlarged sectional view taken along a line 4—4 in FIG. 2;

FIG. 5 is a sectional view taken along a line 5—5 in FIG. 4;

FIG. 6 is a sectional view taken along a line 6—6 in FIG. 4;

FIG. 7 is a sectional view taken along a line 7—7 in FIG. 2;

FIG. 8 is a sectional view taken along a line 8—8 in FIG. 2;

FIG. 9 is a sectional view taken along a line 9—9 in FIGS. 4 and 7;

FIG. 10 is a sectional view taken along a line 10—10 in FIGS. 4 and 7;

FIG. 11 an enlarged sectional view of an essential portion shown in FIG. 1; and FIG. 12 is a skeleton diagram of a cooling system.

DETAILED DESCRIPTION OF THE PREFERRED EMBODIMENT

The present invention will now be described by way of an embodiment with reference to the accompanying drawings.

Figure 1:
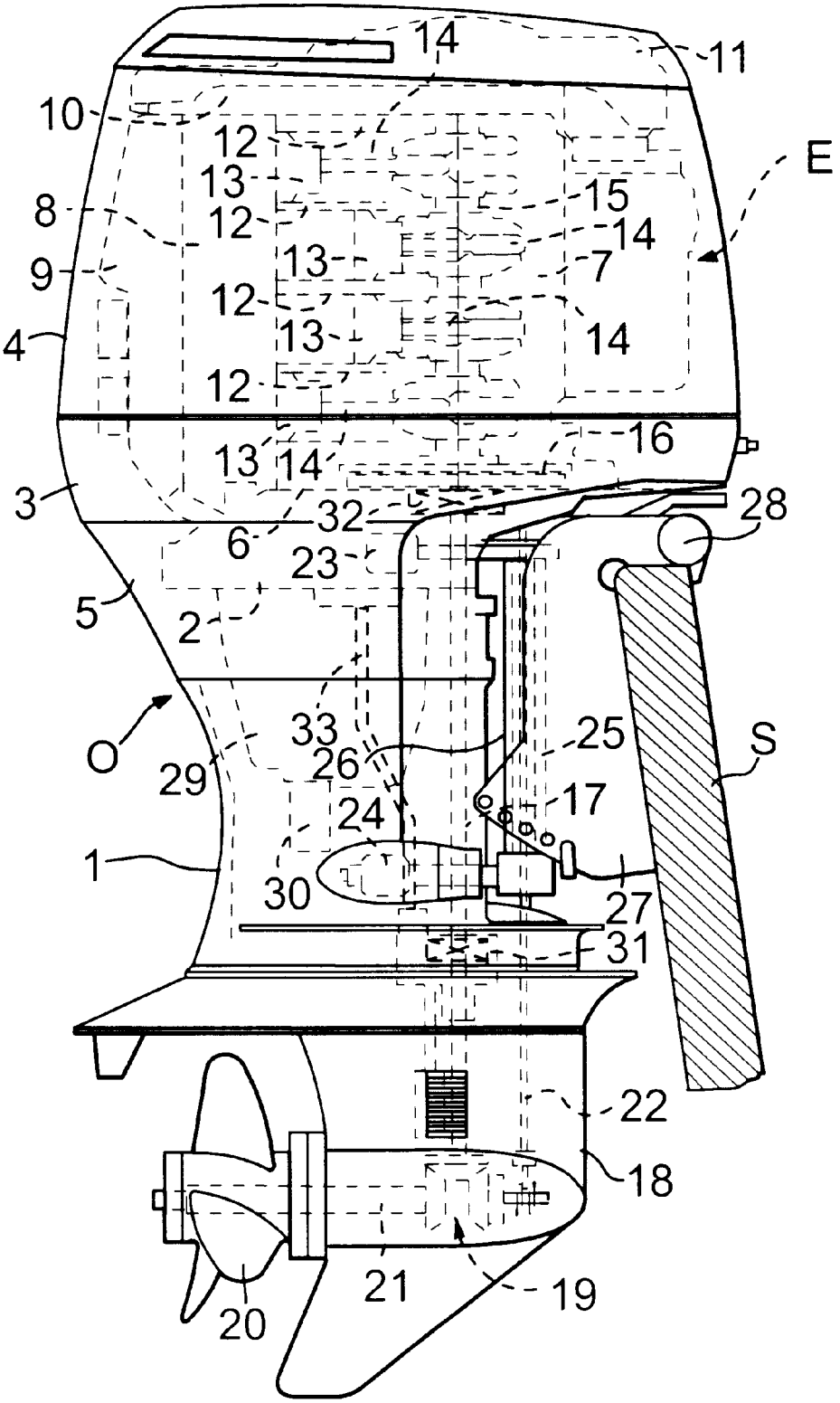

Referring to FIG. 1, an outboard engine system O includes a mount case 2 coupled to an upper portion of an extension case 1, and a water-cooled in-line type 4-cylinder and 4-cycle engine E is carried on an upper surface of the mount case 2 with its crankshaft 15 arranged vertically. An under-case 3 with an upper surface opened is coupled to the mount case 2, and an engine cover 4 is detachably mounted to an upper portion of the under-case 3. An under-cover 5 is mounted between a lower edge of the under-case 3 and an edge of the extension case 1 near its upper end to cover the outside of the mount case 2.

The engine E includes a cylinder block 6, a crankcase 7, a cylinder head 8, a head cover 9, a lower belt cover 10 and an upper belt cover 11. Lower surfaces of the cylinder block 6 and the crankcase 7 are supported on the upper surface of the mount case 2. Pistons 13 are slidably received in four cylinders 12 defined in the cylinder block 6 and are connected to the vertically disposed crankshaft 15 through connecting rods 14, respectively.

A driving shaft 17, which is connected to a lower end of the crankshaft 15 along with a flywheel 16, extends downwards through the inside of the extension case 1, with its lower end being connected to a propeller shaft 21 having a propeller 20 at its rear end, through a bevel gear mechanism 19 mounted within a gear case 18. A shift rod 22 is connected at its lower end to a front portion of the bevel gear mechanism 19 to switch over the direction of rotation of the propeller shaft 21.

A swivel shaft 25 is fixed between an upper mount 23 provided on the mount case 2 and a lower mount 24 provided on the extension case 1, and a swivel case 26 for rotatably supporting the swivel shaft 25 is vertically swingably supported on a stern bracket 27 mounted at a stern S through a tilt shaft 28.

An oil pan 29 and an exhaust pipe 30 are coupled to a lower surface of the mount case 2. An exhaust gas discharged through from the exhaust pipe 30 into an internal space in the extension case 1 is passed through an internal space in the gear case 18 and through the inside of a boss portion of the propeller 20 and discharged into the water. A water pump 31 and an oil pump 32 are mounted at a lower portion and an upper portion of the driving shaft 17, respectively. The water pump 31 supplies the water pumped through the cooling-water pipe 33 into the cooling-water jacket in the engine E. The oil pump 32 supplies an oil pumped from the oil pan 29 to lubricated portions of the engine E.

Figure 3:
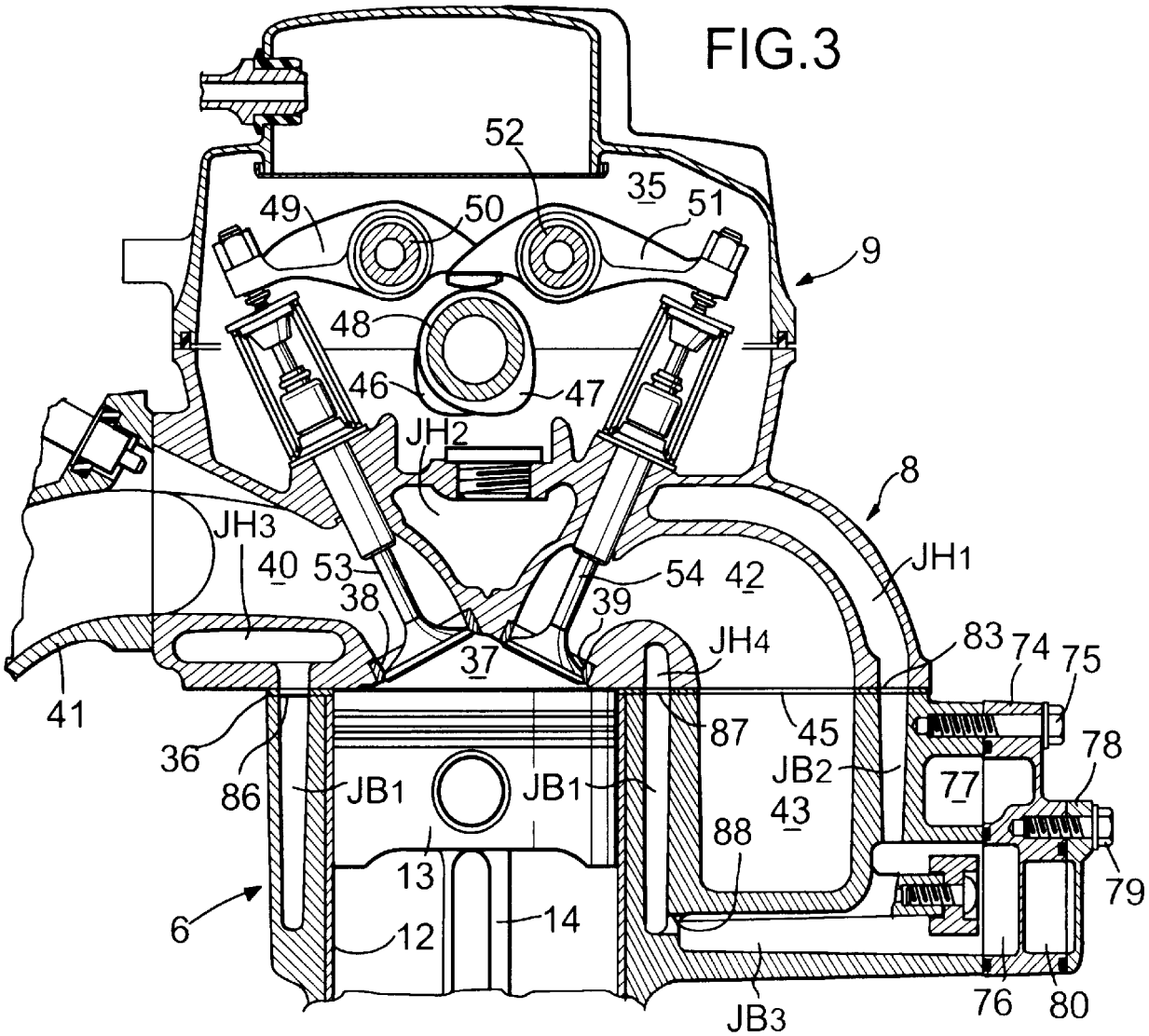
Figure 4:
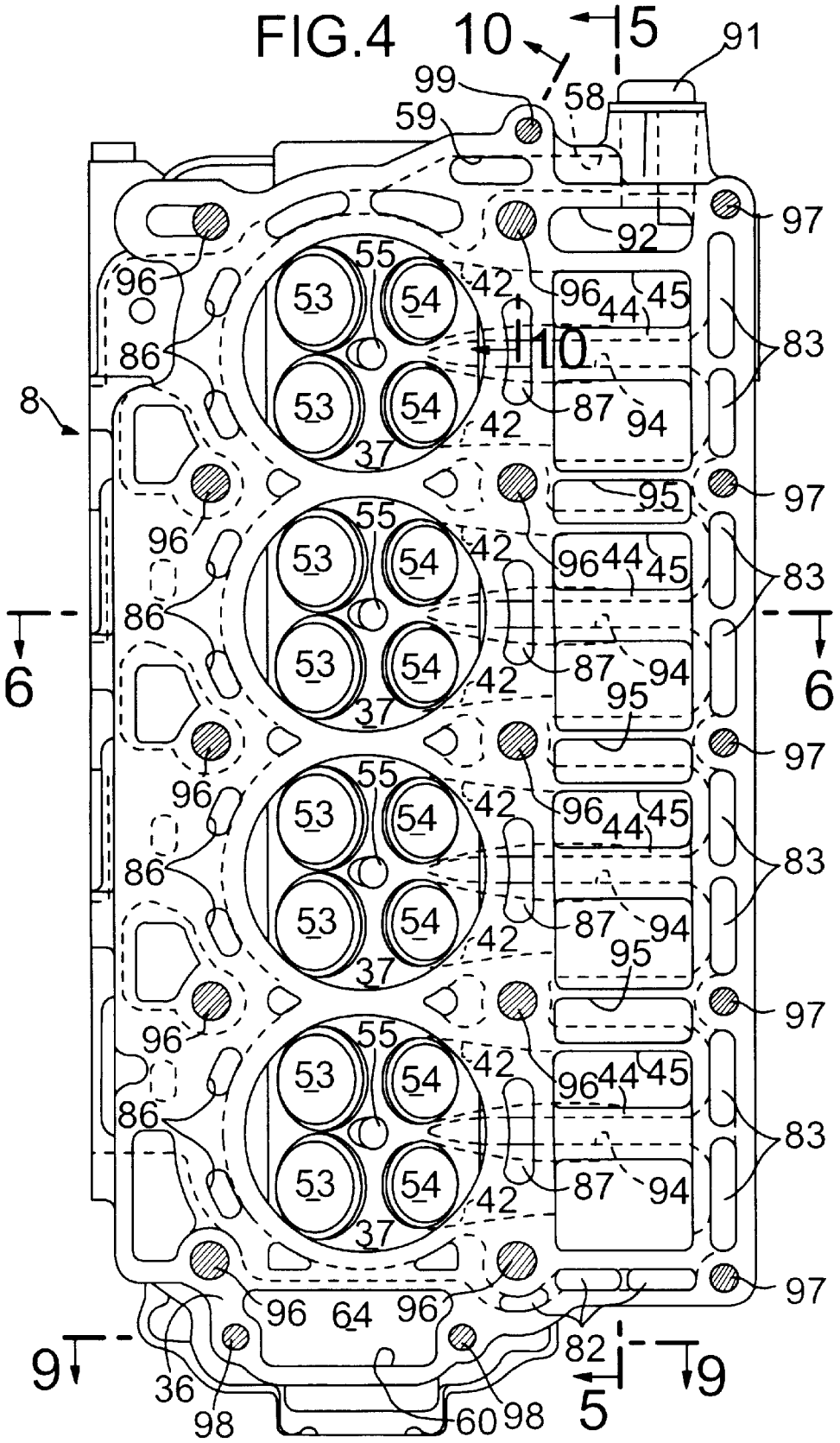

As shown in FIGS. 3 and 4, the cylinder head 8 is provided with four combustion chambers 37 which open into a cylinder block/cylinder head coupling surface 36 which couples the cylinder block 6 and the cylinder head 8 to each other. A pair of intake bores 38 and a pair of exhaust bores 39 are defined in each of the combustion chambers 37. A pair of intake passages 40 extending from the pair of intake bores 38 are connected to an intake manifold 41 at a side of the cylinder head 8. A pair of first exhaust passages 42 extending from the pair of exhaust bores 39 are connected to a common second exhaust passage 43 vertically defined in the cylinder block 6 through an opening 45 in the cylinder block/cylinder head coupling surface 36. A partition wall 44 for partitioning the pair of exhaust passages 40 for each of the combustion chambers 37 terminates slightly short of the opening 45 in the cylinder block/cylinder head coupling surface 36 (see FIG. 5) and hence, the pair of exhaust passages 40 communicate with the second exhaust passage 43 through the common opening 45.

Provided in a valve-operating chamber 35 surrounded by the cylinder head 8 and the head cover 9 are a cam shaft 48 having an intake can 46 and an exhaust cam 47 which correspond to each of the combustion chambers 37, an intake rocker shaft 50 having an intake rocker arm 49 swingably carried thereon, and an exhaust rocker shaft 52 having an exhaust rocker arm 51 swingably carried thereon. The exhaust rocker arm 49 with one end abutting against the intake cam 46 has the other end abutting against a stem end of an intake valve 53 for opening and closing the intake bore 38, while the exhaust rocker arm 51 with one end abutting against the exhaust cam 47 has the other end abutting against a stem end of an exhaust valve 54 for opening and closing the exhaust bore 39. As can be seen from FIG. 6, a tip end of spark plug 55 threadedly mounted in the cylinder head 8 faces a central portion of each of the combustion chambers 37.

Figure 7:
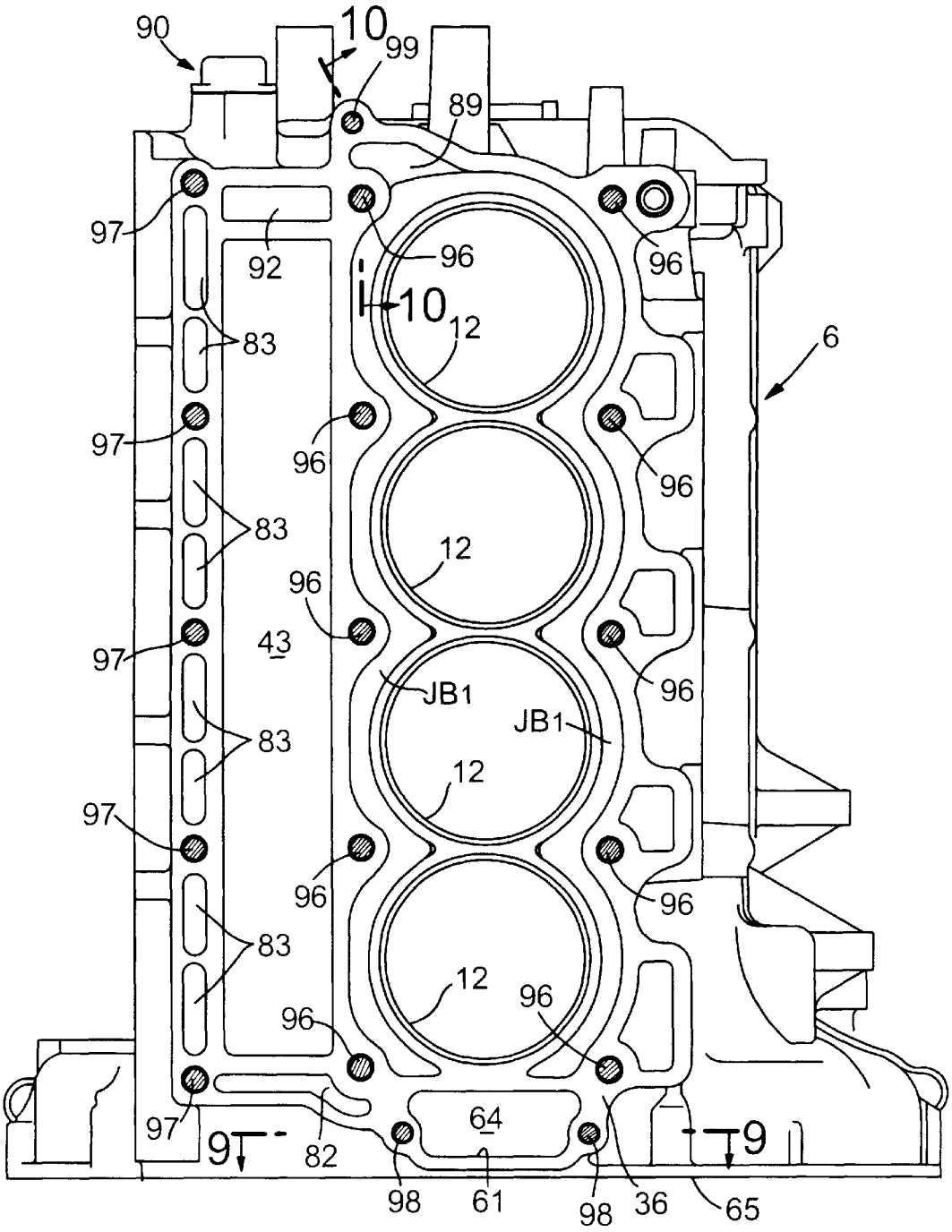
Figure 11:
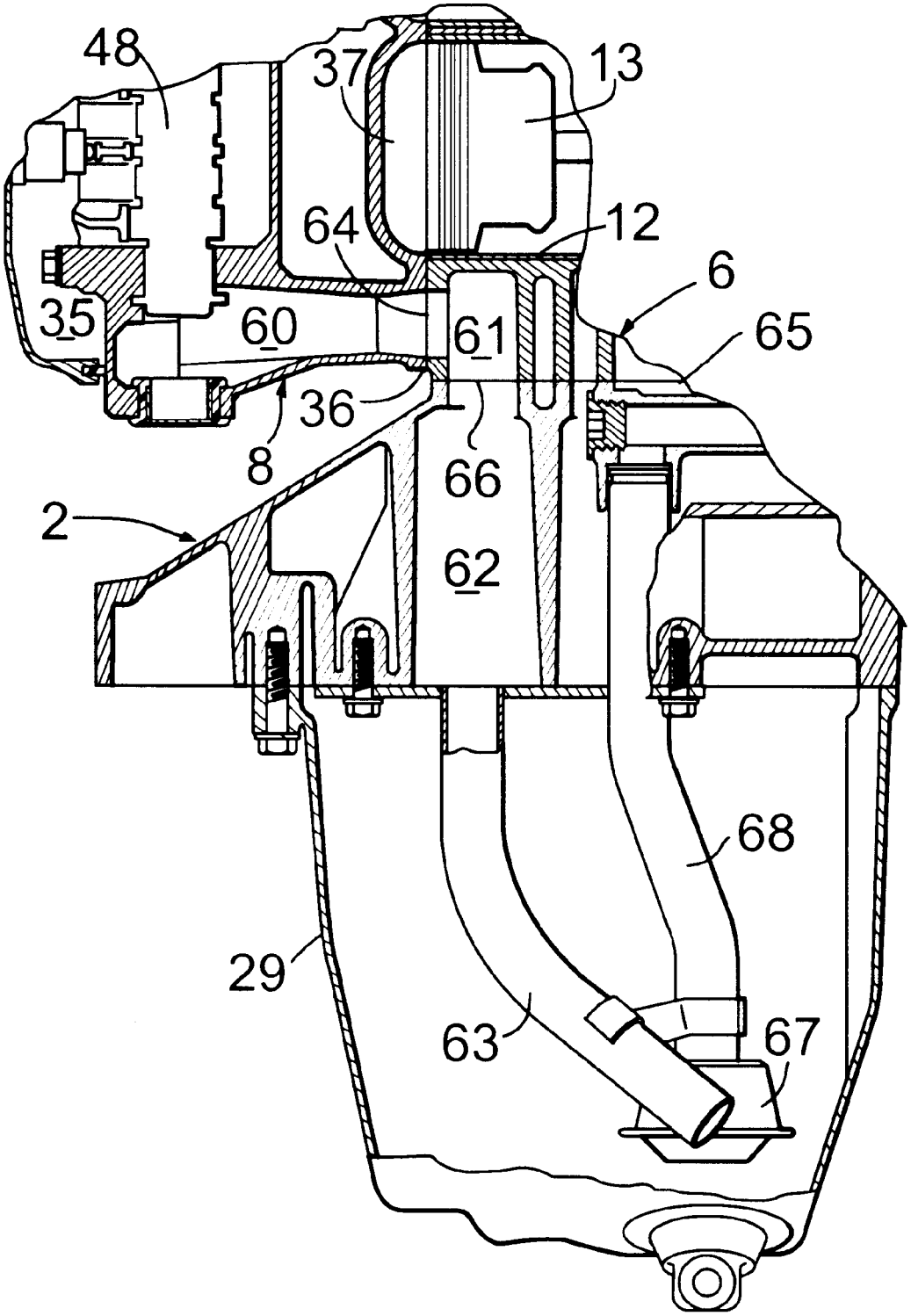

As can be seen from FIGS. 4, 7 and 11, in order to return the oil resident at a lower end of the valve operating chamber 35 to the oil pan 29, the valve operating chamber 35 and the oil pan 29 communicate with each other by a first oil passage 60 defined in the cylinder head 8, a second oil passage 61 defined in the cylinder block 6, a third oil passage 62 defined in the mount case 2 and an oil return pipe 63 fixed to the lower surface of the mount case 2. The second oil passage 61 defined in the cylinder block 6 is bent into an L-shape in section, and communicates at one end thereof with the first oil passage 60 in the cylinder head 8 through an opening 64 (see FIGS. 4 and 7) which faces the cylinder block/cylinder head coupling surface 36, and at the other end thereof with the third oil passage 62 in the mount case 2 through an opening 66 (see FIG. 8) which faces a cylinder block/mount case coupling surface 65. In FIG. 11, reference characters 67 and 68 designate a mesh-accommodated strainer and an oil supply pipe connected to the oil pump 32 (see FIG. 1), respectively.

Figure 12:
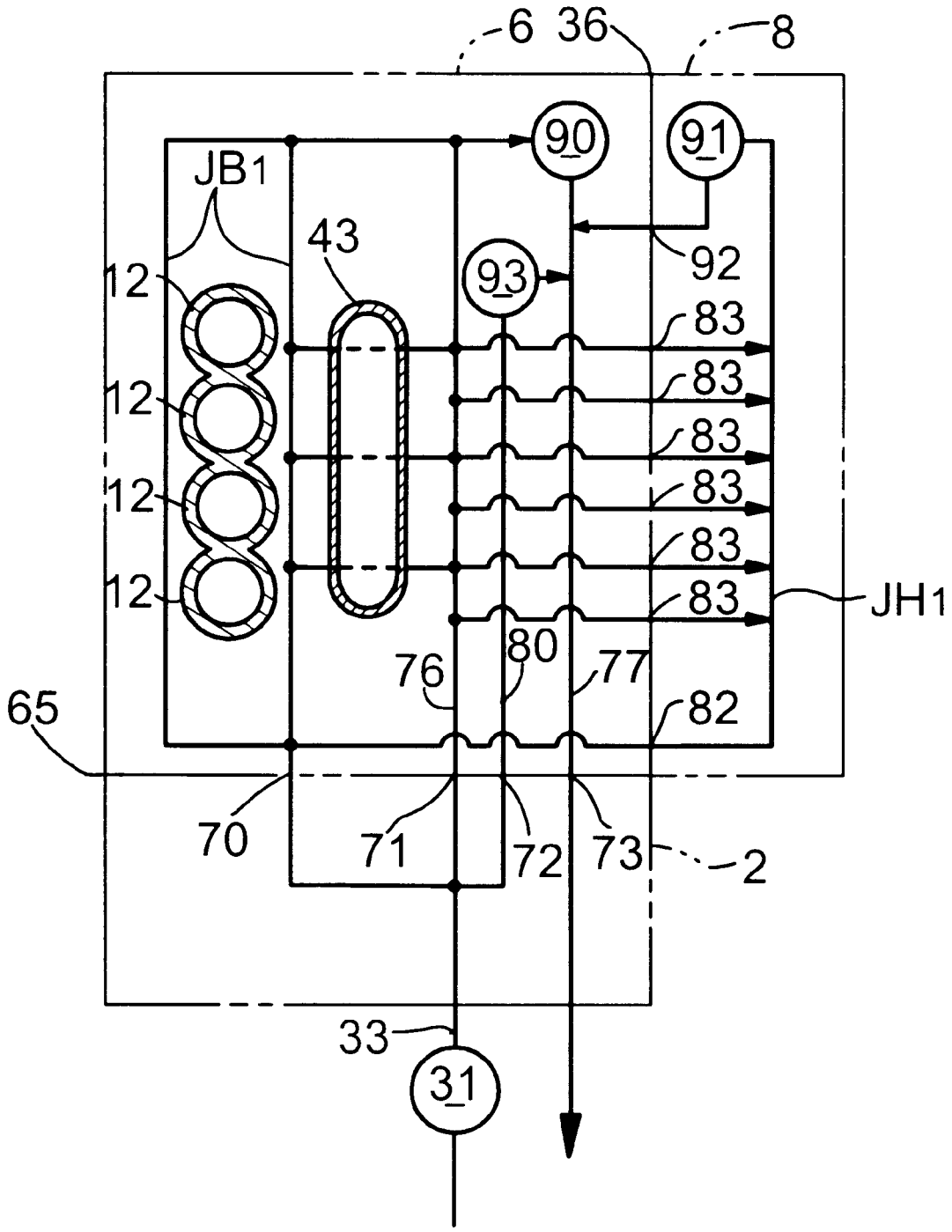

An engine cooling system will be described below with reference to mainly a skeleton diagram in FIG. 12 in combination with FIGS. 3 to 8.

Figure 8:
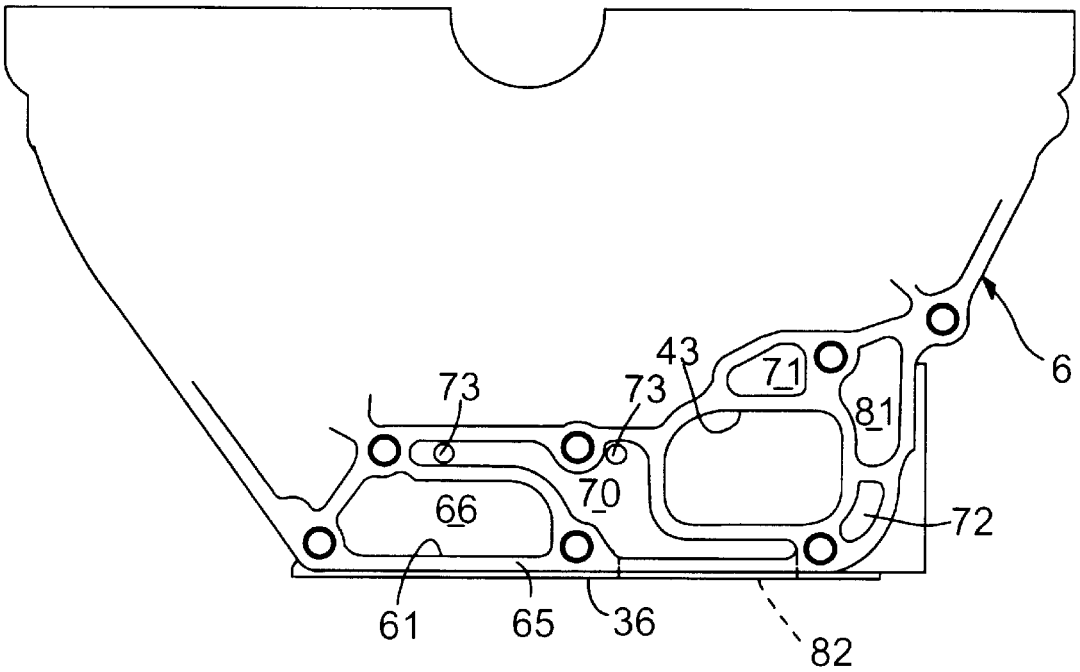

The cooling water pumped by the water pump 31 is passed upwards from below through the mount case 2 to flow into the cylinder block 6 through three openings 70, 71 and 72 defined in the cylinder block/mount case coupling surface 65 (see FIG. 8). A cooling water jacket $JB_1$ (see FIGS. 3 and 7) is defined in the cylinder block 6 to surround outer peripheries of the four cylinders 12, and communicate with the opening 70 through two through-holes 73 (see FIG. 8).

Figure 2:
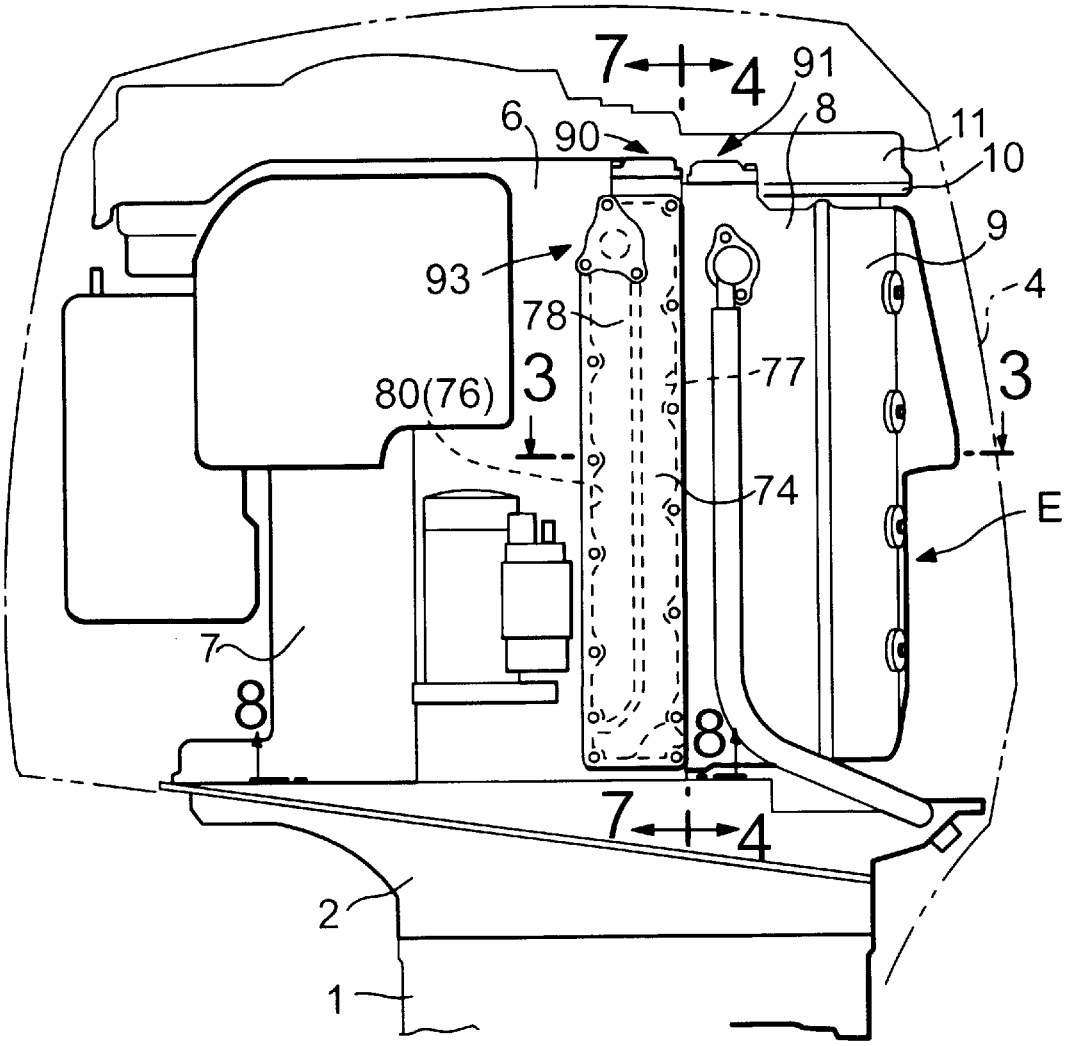

As can be seen from FIGS. 2 and 3, a first cover 74 is fixed to an outer wall surface of the second exhaust passage 43 in the cylinder block 6 by a bolt 75, and a cooling water supply passage 76 and a cooling water discharge passage 77 are defined in parallel to each other between the cylinder block 6 and the first cover 74. A second cover 78 is fixed to the outside of the first cover 74 by a bolt 79, and a relief passage 80 is defined between the first and second covers 74 and 78. A lower end of the cooling water supply passage 76 communicates with the opening 71 defined in the cylinder block/mount case coupling surface 65 (see FIG. 8), while a lower end of the relief passage 80 communicates with the opening 72 defined in the cylinder block/mount case coupling surface 65. An opening 81 is further defined in the cylinder block/mount case coupling surface 65 to communicate with the cooling water discharge passage 77. The four openings 71, 72, 73 and 81 are disposed to surround the periphery of the second exhaust passage 43.

The opening 70 in the cylinder block/mount case coupling surface 65 (see FIG. 8) is bent into an L-shape and communicates with an opening 82 (see FIGS. 4, 5 and 7) in the cylinder block/cylinder head coupling surface 36. The opening 82 communicates with a cooling water jacket $JH_1$ (see FIG. 5) in the cylinder head 8. The cooling water jacket $JH_1$ communicates with the cooling water supply passage 76 through a plurality of openings 83 defined in the cylinder block/cylinder head coupling surface 36 and through a cooling water jacket $JB_2$ defined in the cylinder block 6 (see FIG. 5).

As can be seen from FIG. 3, a cooling water jacket $JH_2$ is vertically defined in a central portion of the cylinder head 8, so that it is surrounded by the intake valves 53 and the exhaust valves 54. The cooling water jacket $JH_2$ communicates with the cooling water jacket $JH_1$ through four through-holes 85 (see FIG. 5). In addition, a cooling water jacket $JH_3$ defined inside the intake passages 40 in the cylinder head 8 communicates with the cooling water jacket $JB_1$ in the cylinder block 6 through openings 86 in the cylinder block/cylinder head coupling surface 36, and a cooling water jacket $JH_4$ defined inside the first exhaust passages 42 in the cylinder head 8 communicates with the cooling water jacket $JB_1$ in the cylinder block 6 through openings 87 in the cylinder block/cylinder head coupling surface 36. Further, a cooling water jacket $JB_3$ is defined in the cylinder block 6 to face the second exhaust passage 43 and also communicates with the cooling water jacket $JB_1$ surrounding the cylinders 12 through a plurality of through-holes 88.

A cooling water passage 89 (see FIG. 7) connected to the cooling water jacket $JB_1$ extending upwards within the cylinder block 6 is connected to the cooling water discharge passage 77 via a first thermo-valve 90 on the upper surface of the cylinder block 6. A cooling water passage 58 (see FIG. 4) connected to the cooling water jacket $JH_1$ extending upwards within the cylinder head 8 is connected to the cooling water discharge passage 77 via a second thermo-valve 91 mounted on the upper surface of the cylinder head 8 and via an opening 92 in the cylinder block/cylinder head coupling surface 36. The cooling water passage 89 in the cylinder block 6 and the cooling water passage 58 in the cylinder head 8 communicate with each other via an opening 59 in the cylinder block/cylinder head coupling surface 36 (see FIGS. 4 and 7). An upper end of the relief passage 80 and an upper end of the cooling water discharge passage 77 are connected to each other through a relief valve 93 (see FIG. 2).

The operation of the cooling system having the above-described arrangement will be described below. During a usual operation which is not a warming operation of the engine E, the cooling water pumped through the cooling water pipe 33 by the water pump 31 diverges in three directions within the mount case 2 and flows through the three openings 70, 71 and 72 in the cylinder block/mount case coupling surface 65 into the cylinder block 6. The cooling water flowing through the opening 70 into the cylinder block 6 flows upwards in the cooling water jacket $JB_1$, while cooling the peripheries of the four cylinders 12. The cooling water flowing through the opening 71 is distributed into the cooling water jackets $JB_2$ and $JB_3$ extending along the second exhaust passage 43 defined in the cylinder block 6 and the cooling water jacket $JH_1$ extending along the first exhaust passage 42, while flowing upwards in the cooling water supply passage 76 defined between the cylinder block 6 and the first cover 74, thereby cooling the peripheries of the first and second exhaust passages 42 and 43. A portion of the cooling water flowing through the opening 70 into the cylinder block 6 flows through the opening 82 in the cylinder block/cylinder head coupling surface 36 into the cylinder head 8, and is then joined with the cooling water distributed from the cooling water supply passage 76 and flows upwards in the cooling water jacket $JH_1$ in the cylinder head 8 to cool the peripheries of the first exhaust passages 42.

The cooling water portions passed through the first and second thermo-valves 90 and 91 mounted respectively at the upper ends of the cylinder block 6 and the cylinder head 8 are joined with each other, and flow downwards in the cooling water discharge passage 77, and then, are discharged into the extension case 1. If the pressure of water discharged from the water pump 31 is increased to exceed a predetermined value, the relief valve 93 mounted in the relief passage 80 is opened, permitting the surplus cooling water to be discharged into the cooling water discharge passage 77.

On the other hand, during the warming operation of the engine E, the first and second thermo-valves 90 and 91 are in their closed states to inhibit the flowing of the cooling water portions existing within the cooling water jackets $JB_1$ to $JB_3$ in the cylinder block 6 and the cooling water jackets $JH_1$ to $JH_4$ in the cylinder head 8, and hence, the warming of the engine E is promoted. Even when the throttle opening degree is increased during the warming operation, so that the pressure of water discharged from the water pump 31 is increased to exceed the predetermined value, the relief valve 93 is opened, causing the surplus cooling water to be discharged into the cooling water discharge passage 77.

When the warming of the engine E is completed and the first and second thermo-valves 90 and 91 are opened, the cooling water jackets $JB_1$ to $JB_3$ and $JH_1$ to $JH_4$ communicate with the cooling water discharge passage 77, passing to a state during the usual operation.

The shape of the cooling water jacket $JH_1$ in the cylinder head 8 will be described below in further detail with reference to FIGS. 3 to 6.

Figure 5:
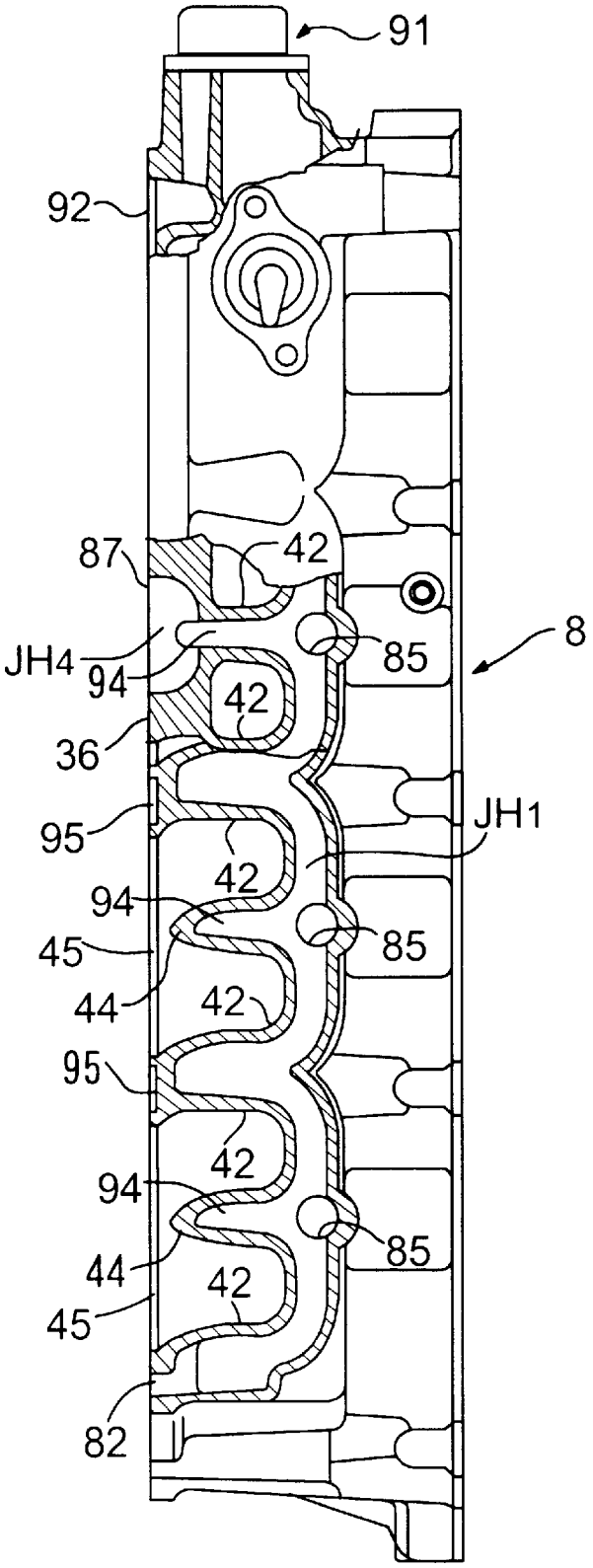
Figure 6:
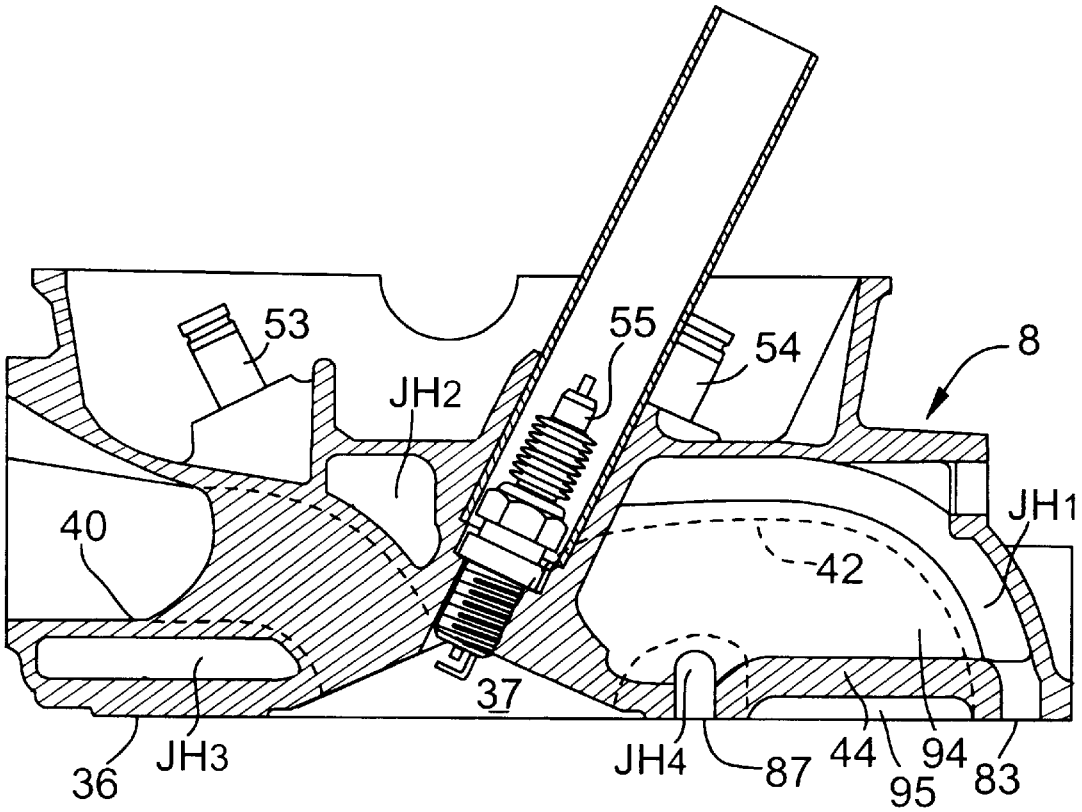

The cooling water jacket $JH_1$ is intended to cool the first exhaust passages 42 defined in the cylinder head 8 and portions near the combustion chambers 37 and formed using a core in producing the cylinder head 8 in a casting process. As best shown in FIGS. 5 and 6, the cooling water jacket $JH_1$ includes an intra-wall passage 94 extending in the partition wall 44 which partitions the pair of adjacent first exhaust passages 42. The intra-wall passage 94 extends to near the combustion chamber 37 and a hole for the spark plug 55. The intra-wall passage 94 is connected, at its portion remoter from the combustion chamber 37, to the opening 83 in the cylinder block/cylinder head coupling surface 36 and communicates, at its portion nearer to the combustion chamber 37, with the cooling water jacket $JH_4$.

By the fact that those portions of the cylinder head 8 which are near the first exhaust passages 42, the combustion chamber 37 and the spark plug 55 and are heated to a highest temperature are surrounded in the above manner by the cooling water jacket $JH_1$ including the intra-wall passage 94 and the cooling water jacket $JH_4$ which permits the cooling water jacket $JH_1$ to be put into communication with the cooling water jacket $JB_1$ in the cylinder block 6 via the through-holes 87, the highest-temperature portions can be effectively cooled.

In FIG. 5, in producing the cylinder head 8 in the casting process, the cooling water jacket $JH_1$ is formed using the core and the cooling water jacket $JH_4$ is formed using a mother die. Provided that the cooling water jackets $JH_1$ and $JH_4$ are formed using the same core, the structure of a die forming such core is complicated. However, if the cooling water jacket $JH_4$ is independently formed in the mother die, the core forming die for forming the cooling water jacket $JH_1$ can be simplified. In FIGS. 4 and 6, reference character 95 designates a recess defined in the cylinder block/cylinder head coupling surface 36 and formed in the mother die simultaneously when the cooling water jacket $JH_4$ is formed.

The cylinder block 6 and the cylinder head 8 are abutted against each other in the cylinder block/cylinder head coupling surface 36 and integrally coupled to each other by ten bolts 96 inserted from the side of the cylinder head 8. As can be seen from FIGS. 4 and 7, four of the bolts 96 are disposed concentrically with respect to a center line of each of the cylinders 12, and two of the bolts 96 are used commonly for the adjacent two cylinders 12. Further, the cylinder block 6 and the cylinder head 8 are integrally coupled to each other with the second exhaust passage 43 sandwiched therebetween on the opposite side from the cylinders 12 by five bolts 97 inserted from the side of the cylinder head 8.

A sufficient force is obtained at a location radially inside the ten bolts 96 coupling the cylinder block 6 and the cylinder head 8 as viewed from the cylinder axes, i.e., at a location corresponding to the cooling water jacket $JB_1$ surrounding the cylinders 12, but only the fastening force of the bolts 96 must be relied on at a location radially outside the ten bolts 96 as viewed from the cylinder axes, particularly, at the lower and upper ends of the cylinder block 6 and the cylinder head 8, which are opposite ends in a direction of arrangement of the four cylinders 12. Therefore, when the opening of the oil passage or the cooling water passage is formed radially outside, there is a problem that such opening cannot be made large, or the radially outward protrusion is limited.

For example, as shown in FIGS. 4 and 7, the opening 64 of the oil passage and the opening 82 of the cooling water passage are formed radially outside the bolts 96 as viewed from the center line of the cylinders 12, in the cylinder block/cylinder head coupling surface 36 at the lower ends of the cylinder block 6 and the cylinder head 8. The shapes, positions and the like of the openings 64 and 82 are limited in design not only being limited in order to meet demands for performance.

Figure 9:
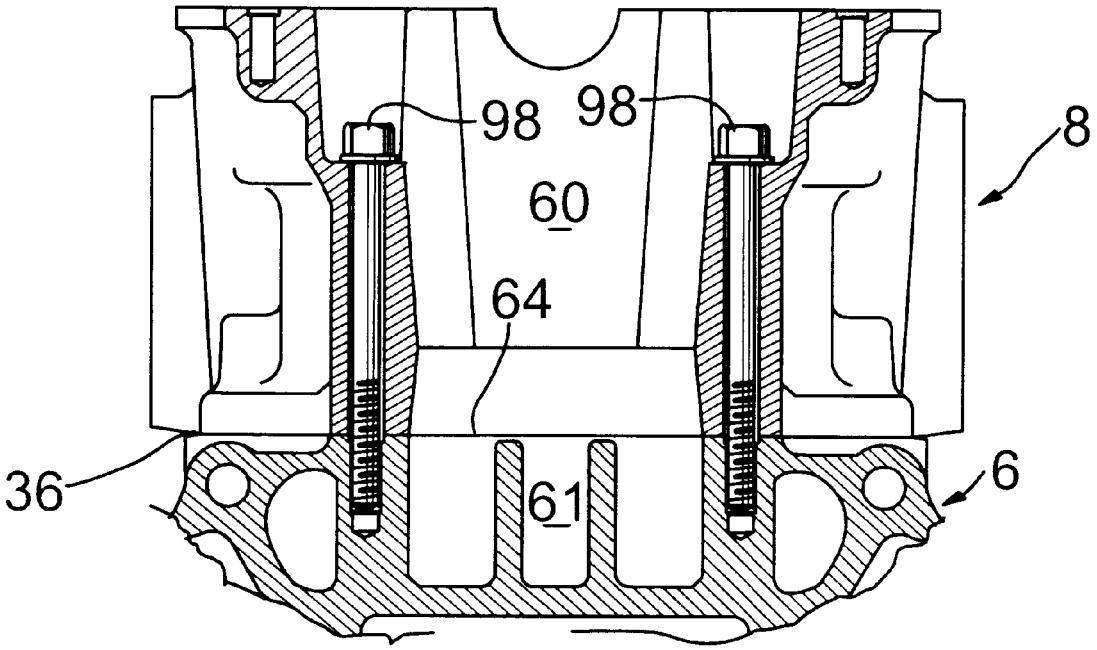

However, by the fact that the cylinder block 6 and the cylinder head 8 are fastened by two bolts 98 located radially outside the bolts 96 surrounding the outer peripheries of the cylinders 12 at locations adjacent the opposite ends of the opening 64 of the oil passage, as shown in FIG. 9, the sealability of the cylinder block/cylinder head coupling surface 36 is enhanced, and the limitation of the shape, position and the like of the openings 64 and 82 is eliminated. Particularly, one of the two bolts 98 is disposed to intervene between the opening 64 of the oil passage and the opening 82 of the cooling water passage 82 adjacent the opening 64, as shown in FIG. 7 and hence, the fastening force therebetween can be sufficiently increased.

As shown in FIGS. 4 and 7, the opening 59 for communication between the cooling water passage 89 in the cylinder block 6 and the cooling water passage 58 in the cylinder head 8 is formed in the cylinder block/cylinder head coupling surface 36 at the upper ends of the cylinder block 6 and the cylinder head 8, so that it is located radially outside the bolts 96 as viewed from the center line of the cylinders 12. Therefore, the shape, position and the like of the opening 58 are limited.

Figure 10:
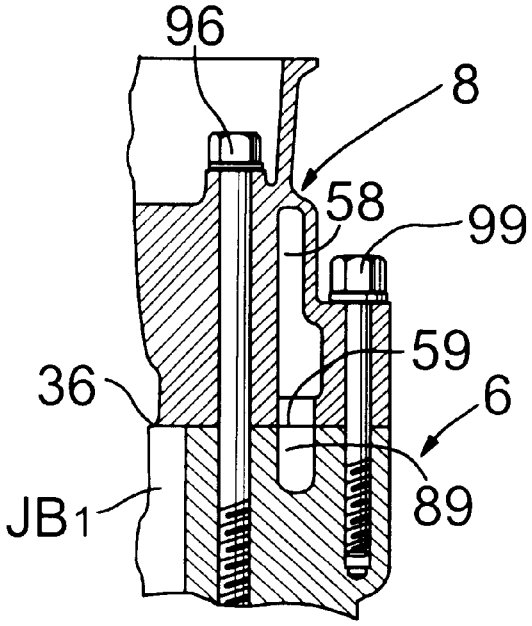

However, by the fact that the cylinder block 6 and the cylinder head 8 are fastened by a single bolt 99 located radially outside the bolts 96 surrounding the outer peripheries of the cylinders 12 in the vicinity of the opening 59 between the cooling water passages 89 and 58, as shown in FIG. 10, the sealability of the cylinder block/cylinder head coupling surface 36 is enhanced. Therefore, the limitation of the shape, position and the like of the opening 59 can be eliminated to enhance the degree of freedom in design.

Although the embodiment of the present invention has been described in detail, it will be understood that the present invention is not limited to the above-described embodiment, and various modifications in design may be made without departing from the spirit and scope of the present invention defined in claims.

For example, the engine E for the outboard engine system O is illustrated in the embodiment, but any of the inventions stated in claims 1 to 4 is applicable to any engine used in an application other than the outboard engine system. In addition, the pair of first exhaust passages 42 are defined in correspondence to each of the combustion chambers 37 in the embodiment, but the engine may include three or more first exhaust passages. In this case, the pair of adjacent exhaust passages correspond to the pair of exhaust passages in claims 1 and 4.

What is claimed is:

1. A water-cooled engine comprising a cylinder block including a cylinder, a cylinder head coupled to the cylinder block and including combustion chambers connected to said cylinder, a pair of exhaust bores which open into each of said combustion chambers, a pair of first exhaust passages defined in said cylinder head and extending from the pair of exhaust bores to a cylinder head/cylinder block coupling surface, a partition wall which is formed in said cylinder head and partitions the pair of first exhaust passages, a second exhaust passage defined in said cylinder block and communicating with said first exhaust passages in said coupling surface, and a cooling water jacket defined in said cylinder head to cool the pair of first exhaust passages, wherein said cooling water jacket includes an intra-wall passage defined in said partition wall, said intra-wall passage communicating with the cooling water jacket defined in said cylinder block through said coupling surface.

2. A water-cooled engine according to claim 1, further including a cooling water jacket defined in said cylinder block and communicating with said intra-wall passage, said cooling water jacket being located outside said second exhaust passage as viewed from the cylinder.

3. A water-cooled engine according to claim 1, further including a cooling water jacket defined in the cylinder block and communicating with the intra-wall passage, said cooling water jacket being located inside said second exhaust passage as viewed from the cylinder.

4. A water-cooled engine, comprising a cylinder block including a cylinder, a cylinder head coupled to said cylinder block and including combustion chambers connected to the cylinder, a pair of exhaust bores which open into each of said combustion chambers, a pair of first exhaust passages defined in said cylinder head and extending from the pair of exhaust bores to a cylinder head/cylinder block coupling surface, a partition wall which is formed in said cylinder head and partitions the pair of first exhaust passages, a second exhaust passage defined in said cylinder block and communicates with said first exhaust passages in said coupling surface, and a cooling water jacket defined in said cylinder head to cool the pair of first exhaust passages, wherein said cooling water jacket includes a cooling water jacket portion including an intra-wall passage defined in said partition wall, and a cooling water jacket portion which extends around said combustion chambers and permits said intra-wall passage to communicate with a cooling water jacket defined in said cylinder block.

5. A water-cooled engine according to any of claims 1 to 4, wherein said engine is used as a power source for an outboard engine system.

* * * * *